US007504940B2

(12) United States Patent
Luebke et al.

(10) Patent No.: US 7,504,940 B2
(45) Date of Patent: Mar. 17, 2009

(54) HOME SYSTEM, METHOD AND WIRELESS NODE EMPLOYING NON-PHYSICAL CONFIGURATION OF EMBEDDED DEVICE OR SENSOR OF A HOUSEHOLD OBJECT

(75) Inventors: Charles J. Luebke, Sussex, WI (US); Luis R. Pereira, Milwaukee, WI (US); William J. Murphy, Cranberry Township, PA (US); John C. Schlotterer, Murrysville, PA (US); Javier E. Piraneque, Cranberry Township, PA (US); Michael L. McManus, Oakdale, PA (US); Jeffrey A. Senn, Pittsburgh, PA (US)

(73) Assignee: Eaton Corporation, Cleveland, OH (US)

( * ) Notice: Subject to any disclaimer, the term of this patent is extended or adjusted under 35 U.S.C. 154(b) by 755 days.

(21) Appl. No.: 11/063,120

(22) Filed: Feb. 22, 2005

(65) Prior Publication Data

US 2006/0197660 A1 Sep. 7, 2006

(51) Int. Cl.
*G08B 1/08* (2006.01)

(52) U.S. Cl. ..... 340/539.26; 340/506; 340/825.36; 340/825.49; 340/505; 340/539.1

(58) Field of Classification Search ..... 340/506, 340/825.36, 825.49, 505, 539.1, 539.26
See application file for complete search history.

(56) References Cited

U.S. PATENT DOCUMENTS 5,400,246 A * 3/1995 Wilson et al. ..... 700/17
5,565,855 A * 10/1996 Knibbe ..... 340/3.51
5,907,279 A 5/1999 Bruins et al.
6,759,956 B2 * 7/2004 Menard et al. ..... 340/539.19
6,934,862 B2 * 8/2005 Sharood et al. ..... 713/300
7,110,836 B2 * 9/2006 Sturm et al. ..... 700/83
7,155,305 B2 * 12/2006 Hayes et al. ..... 700/224
7,228,429 B2 * 6/2007 Monroe ..... 713/182
7,230,939 B2 * 6/2007 Toyoshima ..... 370/338

OTHER PUBLICATIONS

Chipcon, "CC1010 Product Information", http://www.chipcon.com/index.cfm?kat_id=2&subkat_id=55, Oct. 6, 2003, 2 pp.
SearchSecurity.com, "key fob," http://searchsecurity.techtarget.com/sDefinition/0,,sid14_gci795968,00.html, Sep. 22, 2003, 2 pp.
GE Industrial Systems, "Electronic House Magazine Names Smart ConnectionCenter and NetworX NX-8E Product of the Year", Aug. 12, 2003, 2 pp.
GE Industrial Systems, "GE Interlogix Releases The Concord Ultra Security System", Sep. 2, 2003, 2 pp.

* cited by examiner

*Primary Examiner*—Daryl C Pope
(74) *Attorney, Agent, or Firm*—Charles E. Kosinski

(57) ABSTRACT

A sensor node or a control device node is for a home system including a server and a fob. The node includes a household object, and a sensor, control or display device embedded in or substantially within the household object. The sensor, control or display device includes a first wireless port adapted to wirelessly communicate with the server, a second port adapted to communicate with the fob when the fob is proximate to the second port, and a processor operatively associated with the first wireless port and the second port. The processor is adapted to receive proximity information from the second port and responsively communicate with the server through the first wireless port, in order to configure the sensor, control or display device.

23 Claims, 11 Drawing Sheets

HOME SYSTEM, METHOD AND WIRELESS NODE EMPLOYING NON-PHYSICAL CONFIGURATION OF EMBEDDED DEVICE OR SENSOR OF A HOUSEHOLD OBJECT

CROSS-REFERENCE TO RELATED APPLICATION

This application is related to commonly assigned:

U.S. patent application Ser. No. 10/686,016, filed Oct. 15, 2003, entitled "Home System Including A Portable Fob Mating With System Components".

BACKGROUND OF THE INVENTION

1. Field of the Invention

This invention relates generally to home systems and, more particularly, to home systems employing wireless communications, such as, for example, a wireless local area network (WLAN) or a low rate—wireless personal area network (LR-WPAN).

2. Background Information

Wireless communication networks are an emerging new technology, which allows users to access information and services electronically, regardless of their geographic position.

In contrast to wired networks, mesh-type, low rate—wireless personal area network (LR-WPAN) wireless communication networks are intended to be relatively low power, to be self-configuring, and to not require any communication infrastructure (e.g., wires) other than power sources.

Home (e.g., residential; house; apartment) monitoring, security, and automation (control) systems are well known.

A common type of stand-alone sensor for the home is the conventional smoke detector, which typically employs an audible signal for alarming and a blinking light (e.g., a LED) as a normal condition monitor. A family of such stand-alone sensors exists including, for example, audible door alarms.

Relatively low power, radio frequency (RF) lighting control systems employ wall-mounted, battery powered, RF switch "sensors". Such a sensor sends a signal to a remote power control device, such as relay, in order to turn one or more house lights on and off.

Unlike stand-alone devices, a low power, RF sensor device allows its sensor to be connected to a remote controller or monitor. A simple example of this is the automatic garage door opener. In this example, the "sensor" is a button in a car. When the button is pushed, this causes the garage door to open or close.

A known mechanism for associating a particular sensor with a given controller may involve pushing a button on the sensor while also pushing a button on the controller. This process usually requires two people or, else, one person to carry one device to the location of the other device. See, e.g., the description of related art section of U.S. Pat. No. 5,907,279.

It is known to provide a sensor system in which a plurality of sensors are connected, either directly with wires or indirectly with RF communications, to a central control and monitoring device. An example of such a sensor system is a security system, which may include a telephone line for dial out/in communication.

One known home security system combines wired and RF sensors with a central base station having a keypad and a display. The RF sensors transmit to the base station. Somewhat like the handheld or keychain RF remote employed to lock/unlock a car's doors, an RF keyfob is employed to arm/disarm the system. The keyfob only transmits and sends a command one way to the base station. The keyfob does not receive any feedback/confirmation, and does not receive or display any information from the system. The base station does not employ a third party remote monitoring service provider, but can be programmed to dial one or more telephone numbers which are selected by the homeowner.

There is room for improvement in home systems. There is also room for improvement in wireless nodes for home systems.

SUMMARY OF THE INVENTION

These needs and others are met by the present invention, which embeds a sensor, control or display device in or substantially within a household object. The sensor, control or display device includes a first wireless port adapted to wirelessly communicate with a server and a second port, including, for example, a proximity sensor, adapted to communicate with a fob when the fob is proximate to the second port. A processor receives proximity information from the second port and responsively communicates with the server through the first wireless port, in order to configure the sensor, control or display device.

In accordance with one aspect of the invention, a home system comprises: a server comprising a wireless port; a portable fob comprising: a portable housing, a first wireless port adapted to wirelessly communicate with the wireless port of the server, a second port, a user input device, a display, and a processor operatively associated with the first wireless port, the second port, the user input device and the display; and a node comprising: a household object, and a sensor, control or display device embedded in or substantially within the household object, the sensor, control or display device comprising: a first wireless port adapted to wirelessly communicate with the wireless port of the server, a second port adapted to communicate with the second port of the portable fob when the portable fob is proximate to the sensor, control or display device, and a processor operatively associated with the first wireless port of the sensor, control or display device and the second port of the sensor, control or display device, the processor of the sensor, control or display device being adapted to receive proximity information from the second port of the sensor, control or display device and responsively communicate with the server through the first wireless port of the sensor, control or display device, in order to configure the sensor, control or display device.

The second port of the sensor, control or display device may include a proximity sensor embedded within the household object. The household object may have a surface with a label disposed thereon proximate the proximity sensor.

The label may be a removable label including an outline of the portable fob to guide placement of the portable fob on the surface of the household object proximate the proximity sensor.

The second port of the sensor, control or display device may further include a magnet embedded within the household object.

As another aspect of the invention, a node for a home system including a server and a fob comprises: a household object; and a sensor, control or display device embedded in or substantially within the household object, the sensor, control or display device comprising: a first wireless port adapted to wirelessly communicate with the server, a second port adapted to communicate with the fob when the fob is proximate to the second port, and a processor operatively associated with the first wireless port and the second port, the processor being adapted to receive proximity information from the second port and responsively communicate with the server through the first wireless port, in order to configure the sensor, control or display device.

As another aspect of the invention, a method of configuring a household object as part of a home system including a server and a portable fob comprises: embedding a sensor, control or display device in or substantially within the household object; placing the portable fob proximate the household object; and sensing the portable fob being proximate the household object and responsively wirelessly communicating from the sensor, control or display device to the server of the home system, in order to configure the household object as part of the home system.

The method may further include employing a sensor as the sensor, control or display device; embedding the sensor within the household object; and placing the portable fob on the household object proximate the sensor.

The method may include embedding a first magnet and a first proximity sensor within the household object; embedding a second magnet and a second proximity sensor within the portable fob; and placing the portable fob proximate the household object with the first magnet being proximate the second proximity sensor and with the second magnet being proximate the first proximity sensor.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
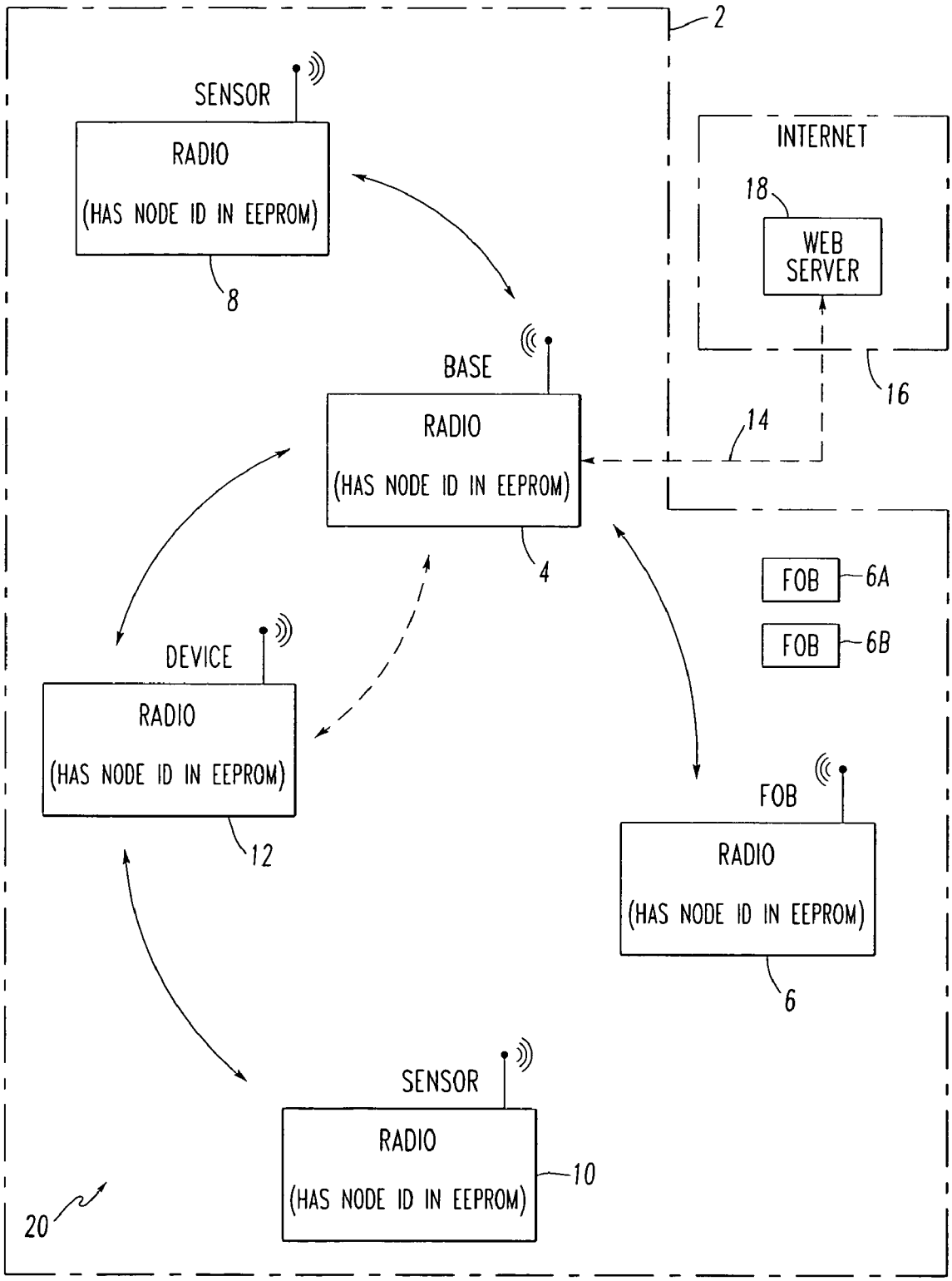
FIG. 1 is a block diagram of a home wellness system in accordance with the present invention.

As employed herein, the term "wireless" shall expressly include, but not be limited by, radio frequency (RF), infrared, wireless area networks, IEEE 802.11 (e.g., 802.11a; 802.11b; 802.11g), IEEE 802.15 (e.g., 802.15.1; 802.15.3, 802.15.4), other wireless communication standards, DECT, PWT, pager, PCS, Wi-Fi, Bluetooth™, and cellular.

As employed herein, the term "communication network" shall expressly include, but not be limited by, any local area network (LAN), wide area network (WAN), intranet, extranet, global communication network, the Internet, and/or wireless communication network.

As employed herein, the term "portable wireless communicating device" shall expressly include, but not be limited by, any portable communicating device having a wireless communication port (e.g., a portable wireless device; a portable personal computer (PC); a Personal Digital Assistant (PDA); a data phone).

As employed herein, the term "fob" shall expressly include, but not be limited by, a portable wireless communicating device; a wireless network device; a wireless object that is directly or indirectly carried by a person; a wireless object that is worn by a person; a wireless object that is placed on or coupled to a household object (e.g., a refrigerator; a table); a wireless object that is coupled to or carried by a personal object (e.g., a purse; a wallet; a credit card case); a portable wireless object; and/or a handheld wireless object.

As employed herein, the term "network coordinator" (NC) shall expressly include, but not be limited by, any communicating device, which operates as the coordinator for devices wanting to join a communication network and/or as a central controller in a wireless communication network.

As employed herein, the term "network device" (ND) shall expressly include, but not be limited by, any communicating device (e.g., a portable wireless communicating device; a fob; a camera/sensor device; a wireless camera; a control device; and/or a fixed wireless communicating device, such as, for example, switch sensors, motion sensors or temperature sensors as employed in a wirelessly enabled sensor network), which participates in a wireless communication network, and which is not a network coordinator.

As employed herein, the term "node" includes NDs and NCs.

As employed herein, the term "headless" means without any user input device and without any display device.

As employed herein, the term "server" shall expressly include, but not be limited by, a "headless" base station; and/or a network coordinator.

As employed herein, the term "residence" shall expressly include, but not be limited by, a home, apartment, dwelling, office and/or place where a person or persons reside(s) and/or work(s).

As employed herein, the term "household object" shall expressly include, but not be limited by, an object for a home or other type of residence.

As employed herein, the term "home system" shall expressly include, but not be limited by, a system for a home or other type of residence.

As employed herein, a home wellness system shall expressly include, but not be limited by, a home system for monitoring and/or configuring and/or controlling aspects of a home or other type of residence.

FIG. 1 is a block diagram of a wireless home wellness system 2. The system 2 includes a "headless" RF base station 4, a portable RF fob or "house key" 6, a plurality of RF sensors, such as 8,10, and one or more RF output devices, such as 12 (only one device 12 is shown in FIG. 1). The RF base station 4 may include a suitable link 14 (e.g., telephone; DSL; Ethernet) to the Internet 16 and, thus, to a web server 18. The sensors 8,10 may include, for example, the analog sensor 8 and the on/off digital detector 10. The device 12 may include, for example, a water valve and/or a wide range of output devices. The sensors 8,10, device 12, base station 4 and fob 6 all employ relatively short distance, relatively very low power, RF communications. These nodes 4,6,8,10,12 form a wireless network 20 in which the node ID for each of such nodes is unique and preferably is stored in a suitable non-volatile memory, such as EEPROM, on each such node.

The base station 4 (e.g., a wireless web server; a network coordinator) may collect data from the sensors 8,10 and "page," or otherwise send an RF alert message to, the fob 6 in the event that a critical status changes at one or more of such sensors.

The fob 6 may be employed as both a portable in-home monitor for the various sensors 8,10 and device 12, also, as a portable configuration tool for the base station 4 and such sensors and such device, and, further, as a remote control for such device.

The example base station 4 is headless and includes no user interface. Alternatively, the invention is applicable to servers, such as base stations, having a local or remote user interface. The sensors 8,10 preferably include no user interface, although some sensors may have a status indicator (e.g., an LED (not shown)). The user interface functions are provided by the fob 6 as will be discussed in greater detail, below. As shown with the device 12, the network 20 preferably employs an adhoc, multihop capability, in which the sensors 8,10, the device 12 and the fob 6 do not have to be within range of the base station 4, in order to communicate.

Figure 2:
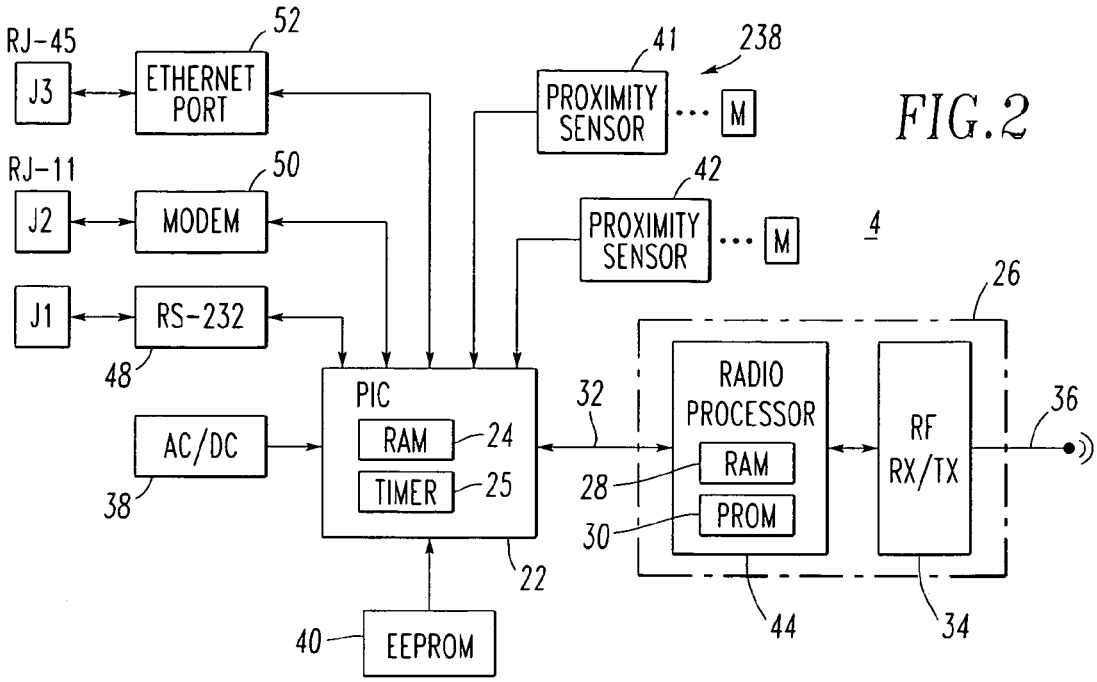
FIG. 2 is a block diagram of the base station of FIG. 1.

FIG. 2 shows the base station 4 of FIG. 1. The base station 4 includes a suitable first processor 22 (e.g., PIC® model 18F2320, marketed by Microchip Technology Inc. of Chandler, Ariz.), having RAM memory 24 and a suitable second radio or RF processor 26 having RAM 28 and PROM 30 memory. The first and second processors 22,26 communicate through a suitable serial interface (e.g., SCI; SPI) 32. The second processor 26, in turn, employs an RF transceiver (RX/TX) 34 having an external antenna 36. As shown with the processor 22, the various base station components receive power from a suitable AC/DC power supply 38. The first processor 22 receives inputs from a timer 25 and one or more proximity sensors 41,42 (e.g., which detect mating or engagement with the fob 6 of FIG. 1). The EEPROM memory 40 is employed to store the unique ID of the base station 4 as well as other nonvolatile information such as, for example, the unique IDs of other nodes, which are part of the wireless network 20, and other configuration related information. The second processor 26 may be, for example, a CC1010 RF Transceiver marketed by Chipcon AS of Oslo, Norway. The processor 26 incorporates a suitable microcontroller core 44, the relatively very low-power RF transceiver 34, and hardware DES encryption/decryption (not shown).

The base station 4 preferably also includes one or more interfaces 48,50,52 to a personal computer (PC) (not shown), a telephone line (not shown) and a network, such as an Ethernet local area network (LAN) (not shown). In this example, the PIC processor 22 communicates with a local PC through a suitable RS-232 interface 48 and connector J1, with a telephone line through a suitable modem 50 and connector J2, and with an Ethernet LAN through an Ethernet port 52 and connector J3. Hence, the modem 50 may facilitate communications with a remote cellular telephone, other portable electronic device (e.g., a PDA (not shown)) or a remote service provider (not shown), and the Ethernet port 52 may provide communications with the Internet 16 of FIG. 1 and, thus, with a remote PC or other client device (not shown).

Figure 3:
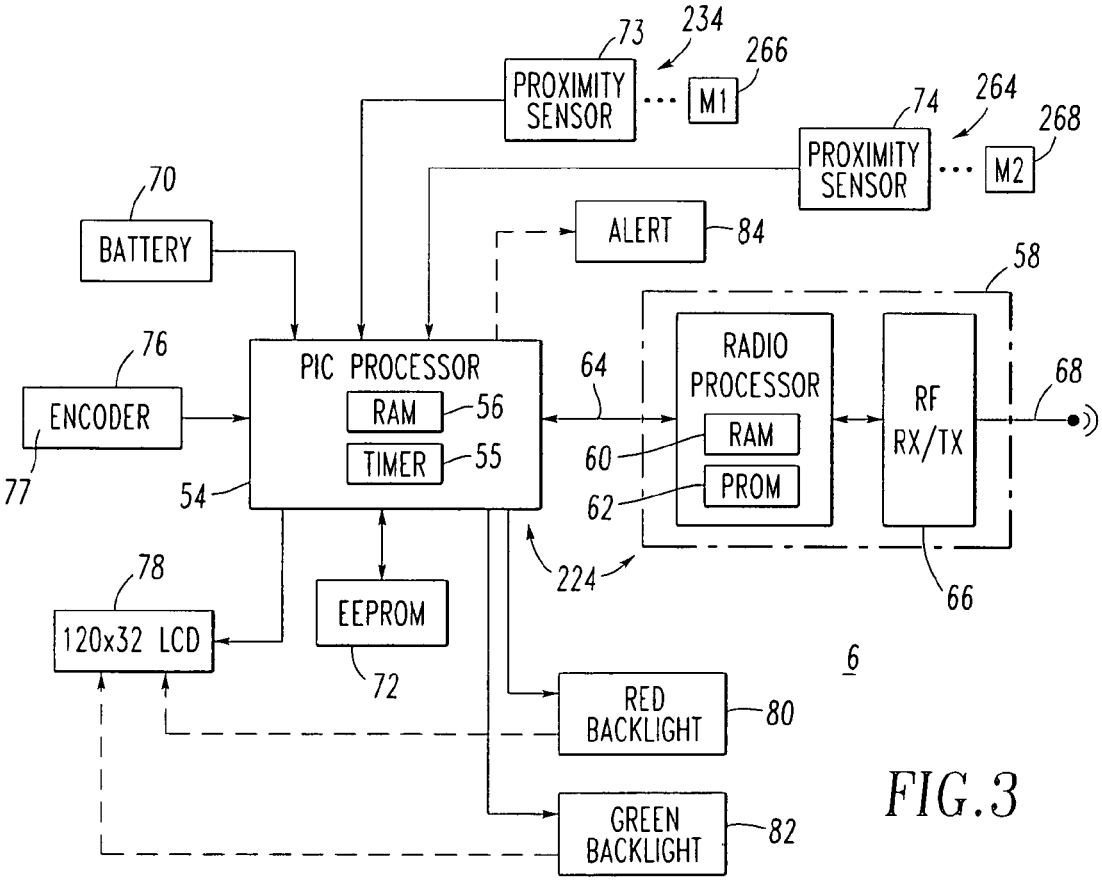
FIG. 3 is a block diagram of the fob of FIG. 1.

FIG. 3 is a block diagram of the fob 6 of FIG. 1. The fob 6 includes a suitable first processor 54 (e.g., PIC) having RAM memory 56 and a suitable second radio or RF processor 58 having RAM 60 and PROM 62 memory. The first and second processors 54,58 communicate through suitable serial interface (e.g., SCI; SPI) 64. The EEPROM memory 72 is employed to store the unique ID of the fob 6 as well as other nonvolatile information. For example, there may be a non-volatile storage for icons, character/font sets and sensor labels (e.g., the base station 4 sends a message indicating that an on/off sensor or device is ready to configure, and the fob 6 looks up the on/off sensor or device and finds a predefined list of names to choose from). This expedites a relatively rapid interaction. The fob 6 may also employ a short term memory cache (not shown) that is used when the fob 6 is out of range of the base station 4. This stores the list of known sensors and devices and their last two states. This permits the user, even if away, to review, for example, what door was open or what valve was closed, when the fob 6 was last in range.

The second processor 58, in turn, employs an RF transceiver (RX/TX) 66 having an antenna 68 (e.g., which is internal to the fob 6). As shown with the processor 54, the various components of the fob 6 receive power from a battery 70. The first processor 54 receives inputs from a timer 55, one or two suitable sensor/base/device proximity sensors 73,74 (e.g., which detect mating or engagement with one of the sensors 8,10 or with the device 12 or with the base station 4 of FIG. 1), and a user input device, such as, for example, the exemplary encoder 76 or rotary selector/switch, such as a thumbwheel encoder. Typically, such encoder 76 also includes a button 77, through which the user presses, clicks and/or double-clicks to initiate actions through the fob user interface. The first processor 54 also sends outputs to a suitable display 78 (e.g., a 120×32 LCD), one or more visual alerts, such as a red backlight 80 (e.g., an alert is present) and a green backlight 82 (e.g., no alert is present) for the display 78, and an alert device 84 (e.g., a suitable audible, visual or vibrating device providing, for example, a sound, tone, buzzer, vibration or flashing light).

The proximity sensors 73,74 may include, for example, a magnet and a reed switch (e.g., a magnet and a reed switch proximity sensor in which a corresponding magnet on the opposing device "triggers" it when they are brought within suitable proximity). The reed switch may be, for example, part number RI02-SMD-G2 marketed by Coto Technology of Providence, R.I. The reed switch may be actuated by an electromagnet, a permanent magnet or a combination of both. The magnet, such as 266, may be, for example, a neodymium rare earth magnet, part number 43511 Nd disk, marketed by Indigo Instruments of Waterloo, Ontario, Canada.

Alternatively, any suitable device or sensor may be employed to detect that the fob 6 has engaged or is suitably proximate to another system node, such as the base station 4 or sensors 8,10 or device 12 of FIG. 1. Other, non-limiting examples of suitable proximity sensors include an optical (e.g., infrared) transmitter/receiver pair, or an RFID tag/reader pair.

The encoder 76 may be, for example, an AEC11BR series encoder marketed by CUI Inc. of Beaverton, Oreg. Although the encoder 76 is shown, any suitable user input device (e.g., a combined rotary switch and pushbutton; touch pad; joystick button) may be employed. Although the alert device 84 is shown, any suitable annunciator (e.g., an audible generator to generate one or more audible tones to alert the user of one or more corresponding status changes; a vibrational generator to alert the user by sense of feel; a visual indicator, such as, for example, an LED indicator to alert the user of a corresponding status change) may be employed. The display 78 preferably provides both streaming alerts to the user as well as optional information messages.

Figure 4:
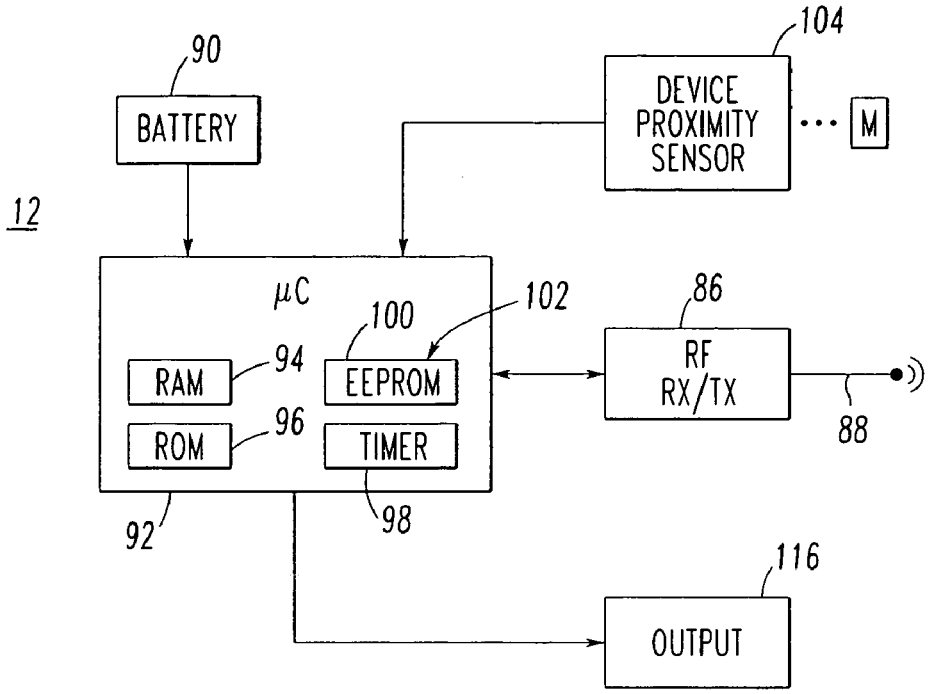
FIG. 4 is a block diagram of the control device of FIG. 1.
Figure 5:
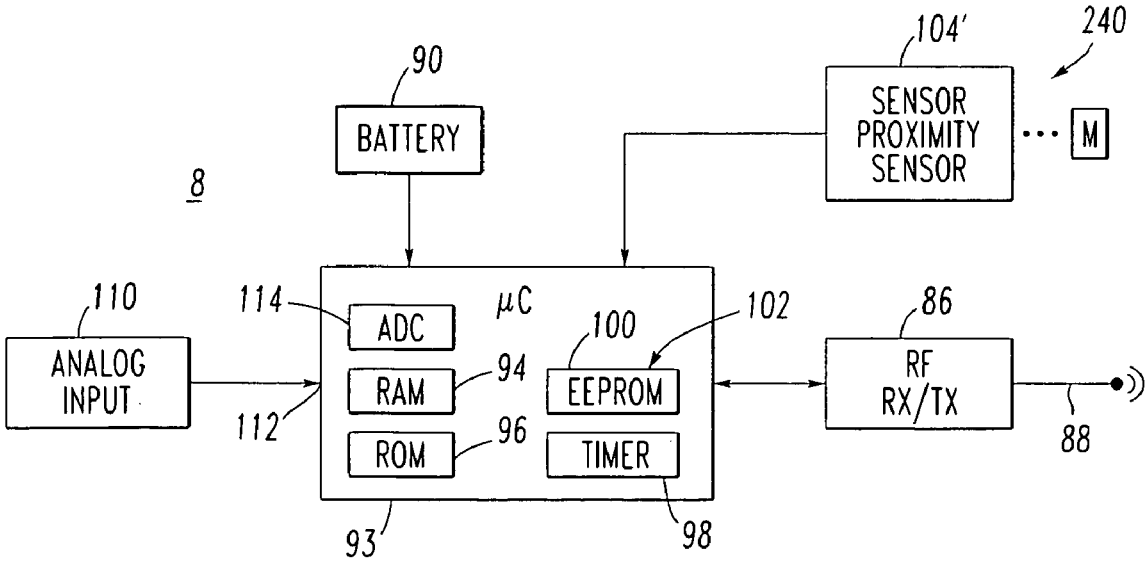
FIG. 5 is a block diagram of one of the input sensors of FIG. 1.

FIGS. 4 and 5 are block diagrams of the device 12 and the analog sensor 8, respectively, of FIG. 1. Each of the device 12 and the sensor 8 includes an RF transceiver (RF RX/TX) 86 having an external antenna 88, a battery 90 for powering the various sensor components, a suitable processor, such as a microcontroller (μC) 92 or 93 having RAM 94, ROM 96, a timer 98 (e.g., in order to provide, for example, a periodic wake-up of the corresponding μC 92 or 93, in order to periodically send device or sensor status information back to the base station 4 of FIG. 1) and other memory (e.g., EEPROM 100 including the unique ID 102 of the node which is stored therein during manufacturing), and a device or sensor proximity sensor 104,104' for mating with one of the fob proximity sensors 73,74 of FIG. 3.

Alternatively, the device 12 may be powered from a suitable AC/DC power source (not shown). The device 12 of FIG. 4 includes a suitable control output 116 (e.g., adapted to open and/or close a water valve). Other non-limiting examples of devices (i.e., output nodes), such as 12, include water valves (shut off; turn on), gas valves (shut off; turn on), electrical switches (power shut off; power turn on), generator (shut off; turn on), garage door (open; close), deadbolt lock (lock; unlock), thermostat (set setpoint), appliance electrical switches (appliance power shut off; appliance power turn on), light switches (shut off lights; turn on lights), communication "firewall" control (enable or secure; disable or insecure), relay device (normally open contact; normally close contact), ×10 gateway (enable; disable), camera trigger (trigger snapshot), and water sprinkler (turn on; turn off). Another example of a device (i.e., output node), such as 12, is a display device, such as a fixed display (e.g., without limitation, a display for a remote thermostat; a display for a remote slave device), a semi-portable display or a portable display, such as of a handheld electronic device (e.g., without limitation, a cellular telephone, a PDA). Another example is adding a suitably modified portable handheld electronic device (e.g., without limitation, PDA; cellular telephone; IPOD®) to the system 2 (FIG. 1) by placing the fob 6 on the back of such a modified handheld electronic device that has an RF sensor 8 (FIG. 5) and/or RF output device 12 (FIG. 4) embedded therein. For example, such a modified device may sense (e.g., monitor) and/or output (e.g., display) system information while in the home.

Examples of the sensors 8,10 of FIG. 1 include water leaks; power outages; abnormal temperatures (e.g., home; refrigerator; furnace; air conditioner; heat pump); motion (e.g., child; pet; elderly person; wild animal); alarm (e.g., open or ajar; door; window; cabinet); appliance on (e.g., iron; television; coffee pot); sound (e.g., smoke alarm; intruder alert); status of detached garage; tremor (e.g., earthquake); odor (e.g., natural gas); pressure (e.g., package delivered to front door mat); manual request (e.g., a button is pressed on a "nameable" sensor, such as, for example, "bring takeout" or "out of milk"). The sensors 8,10 may include, for example, conventional security devices (e.g., motion; door status; window status; smoke; fire; heat; gas (e.g., carbon monoxide, natural gas); alarm) and home condition monitors (e.g., moisture; temperature; power; energy (e.g., natural gas; water; electricity; power)).

When a sensor (i.e., input node) (e.g., water sensor), such as 8,10, joins the wireless network 20 of FIG. 1, the user is prompted by the fob 6 to: (1) select a name for the sensor (e.g., washer; water heater; basement); (2) indicate what event or state change will trigger an alert by the base station 4 (e.g., water present; water absent); and (3) the form of alert (e.g., display message on fob 6; audible tone on fob 6; vibration on fob 6; remote telephone call (e.g., through link 14 of FIG. 1); remote e-mail message (e.g., through link 14 of FIG. 1)).

When a device (output node) (e.g., water valve), such as 12, joins the wireless network 20, the user is prompted by the fob 6 to: (1) select a name for the device (e.g., main water shut off valve; water heater valve); (2) select which of the sensors (or other nodes, such as, for example, fob; pager; cellular telephone; PDA; wireless handheld device), such as 8,10, can control it; and (3) configure any logic (e.g., OR; AND; XOR) to be used for multiple sensor or fob inputs. For example, the first time that any device is added to the system 2 of FIG. 1, the user is automatically taken through fob training menus (not shown), in order to confirm the device name, define the critical control state of the device, select the controller(s), and select the alert method.

The analog sensor 8 of FIG. 5 includes a physical analog input interface 110 (e.g., a water detector) with the μC 93 employing an analog input 112 and a corresponding analog-to-digital converter (ADC) 114.

The device 12 of FIG. 4 and the sensor 8 of FIG. 5 do not include an indicator. It will be appreciated, however, that one or both of such device and sensor may employ an indicator (e.g., to show that a battery 90 is OK; to show that the analog value from the ADC 114 is within an acceptable range of values; to show an on/off input or output state).

Figure 6:
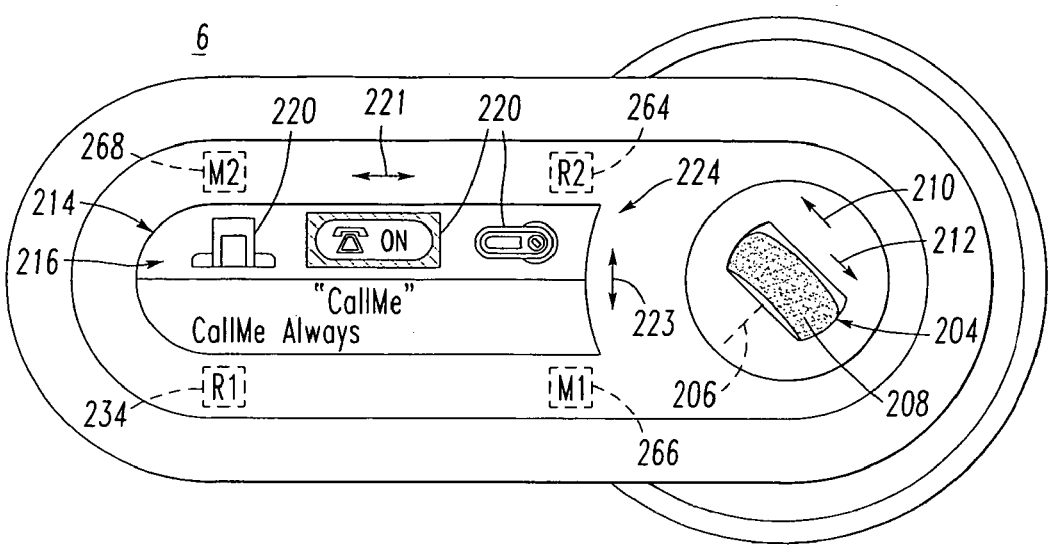
FIG. 6 is a plan view of the fob of FIG. 1.

Referring to FIG. 6, the fob 6 includes an input apparatus 204 having a rotational axis 206 (shown in hidden line drawing) and a wheel, such as a thumbwheel 208, adapted to rotate about the rotational axis 206 in a first rotational direction 210 and an opposite second rotational direction 212. The fob 6 further includes a portable housing 213 and a display 214 alternatively displaying a first list 216 and one or more second lists, such as 318 of FIG. 13B. The example first list 216 includes a plurality of first objects, such as icons 220, disposed in a first longitudinal direction 221 (e.g., horizontal as shown in FIG. 6). The example second list 318 includes a plurality of second objects, such as menu items, disposed in a different second longitudinal direction 223 (e.g., vertical as shown in FIG. 6). The fob 6 also includes a suitable processor component 224 (as best shown in FIG. 3) cooperating with the input apparatus 204 and the display 214 to scroll the first objects or the second objects responsive to rotation of the thumbwheel 208 in the first rotational direction 210 or the opposite second rotational direction 212. As shown in FIG. 6, the rotational axis 206 is disposed at an angle of about 45 degrees with respect to the first or horizontal longitudinal direction 221 and to the second or vertical longitudinal direction 223.

The first rotational direction 210 corresponds to leftward scrolling and upward scrolling, while the second rotational direction 212 corresponds to rightward scrolling and downward scrolling. The horizontal list 216 of FIG. 6 is adapted to scroll leftward responsive to rotation of the thumbwheel 208 in the first rotational direction 210 and to scroll rightward responsive to rotation of the thumbwheel 208 in the second rotational direction 212. The vertical list 318 of FIG. 13B is adapted to scroll upward responsive to rotation of the thumbwheel 208 in the first rotational direction 210 and to scroll downward responsive to rotation of the thumbwheel 208 in the second rotational direction 212.

Figure 7:
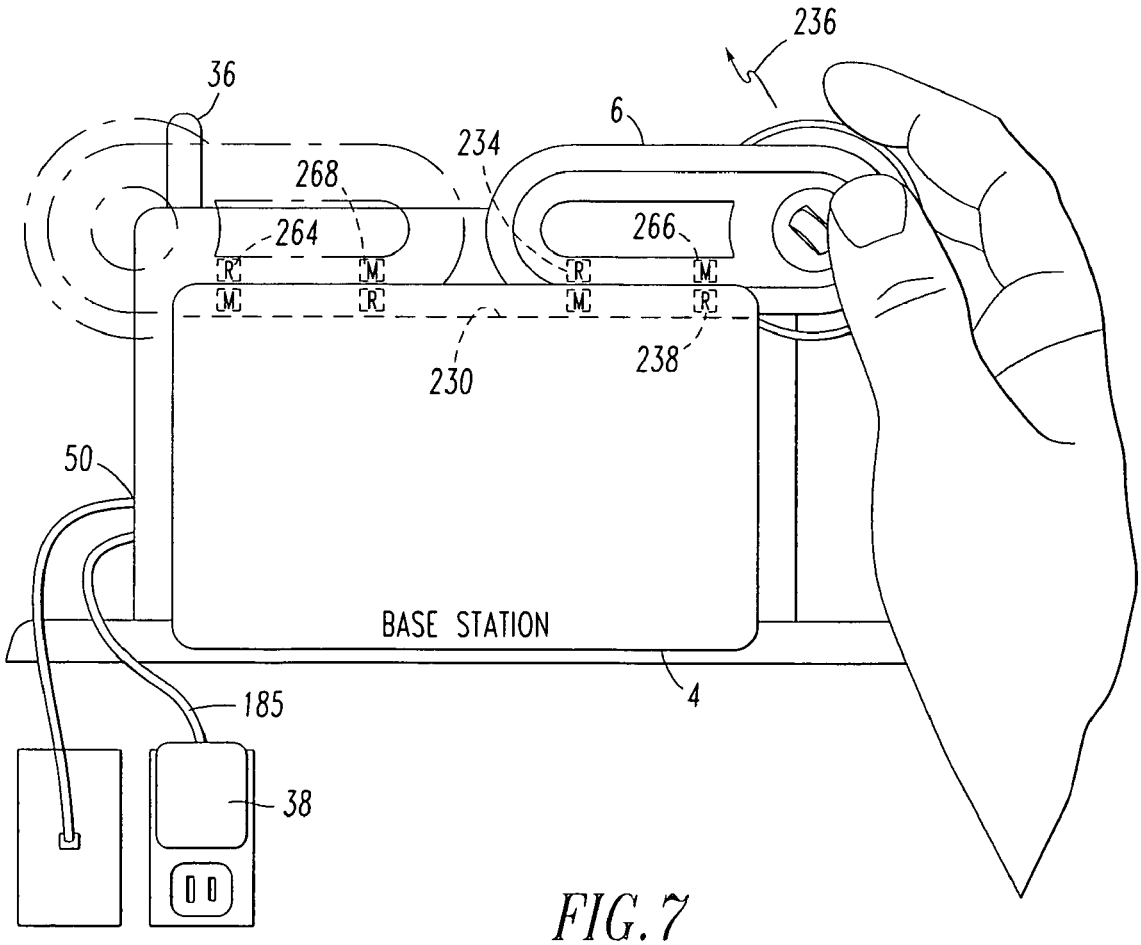
FIG. 7 is a vertical elevation view of the fob mating with the base station of FIG. 1.
Figure 8:
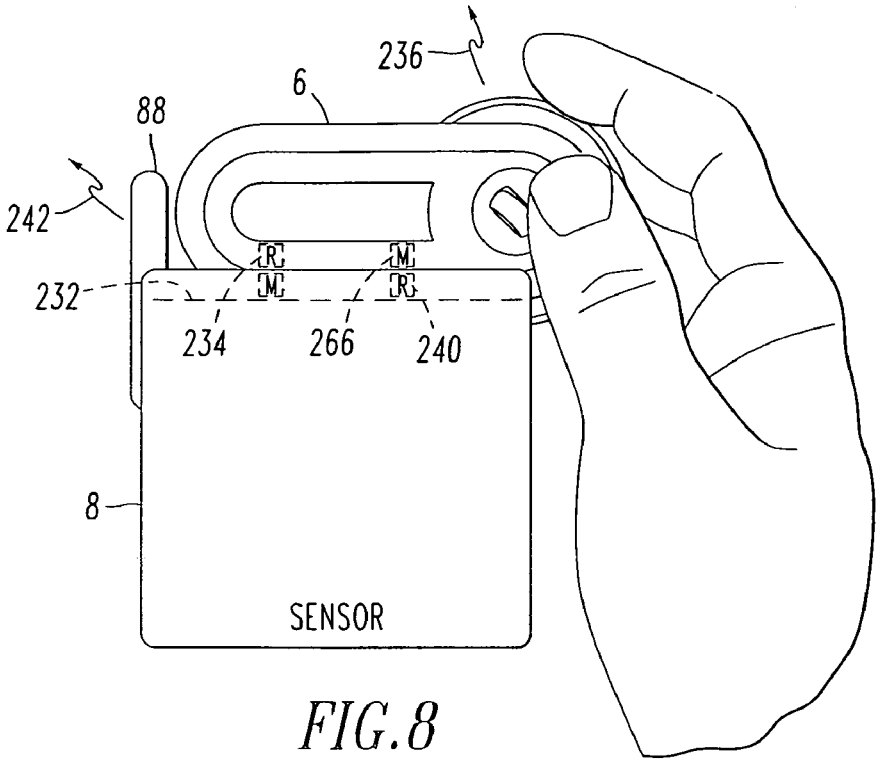
FIG. 8 is a vertical elevation view of the fob mating with the sensor of FIG. 1.

Referring to FIGS. 7 and 8, the home system 2 of FIG. 1 allows for a "tear off" display in the form of the fob 6 to be employed for configuration of the nodes 4,6,8,10,12 of the system 2. This is made possible by the headless base station 4 and the removable (with respect to the base station 4) fob 6.

This removable fob 6 mates (e.g., "docks") in keyway(s) 230 (shown in hidden line drawing in FIG. 7) and 232 (shown in hidden line drawing in FIG. 8) of the nodes 4,8,10,12 and signals its readiness to display information through an embedded proximity sensor (R) 234 and an RF message 236. Initially, the fob 6 is mated with the base station 4 as shown in FIG. 7. Then, to configure additional nodes, such as 8,10,12, to the system 2, the fob 6 is removed from the base station 4 and is mated with (e.g., "docked" in the keyway 232 of) the selected node at which time the embedded proximity sensors (R) 234 and 238 in the fob 6 and the base station, respectively, or the proximity sensors 234 and 240 in the fob 6 and the sensor 8, respectively, are triggered. In response, the fob 6 and the mated node 8 suitably contemporaneously send RF messages 236 and 242, respectively, to the base station 4. Then, as is discussed below in connection with FIGS. 13A-13B and 14A-14B, when the base station 4 receives those messages 236,242, it coordinates the display of sensor or device specific configuration information, which is displayed by the fob 6.

Figure 10:
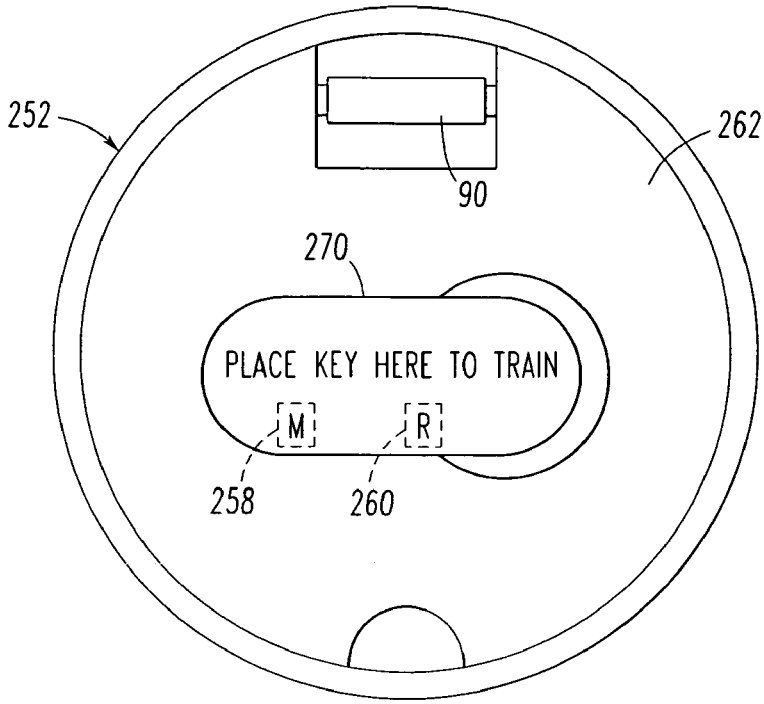
FIG. 10 is a bottom plan view of the base of the pet dish of FIG. 9 which is adapted to mate with the fob of FIG. 6.
Figure 11:
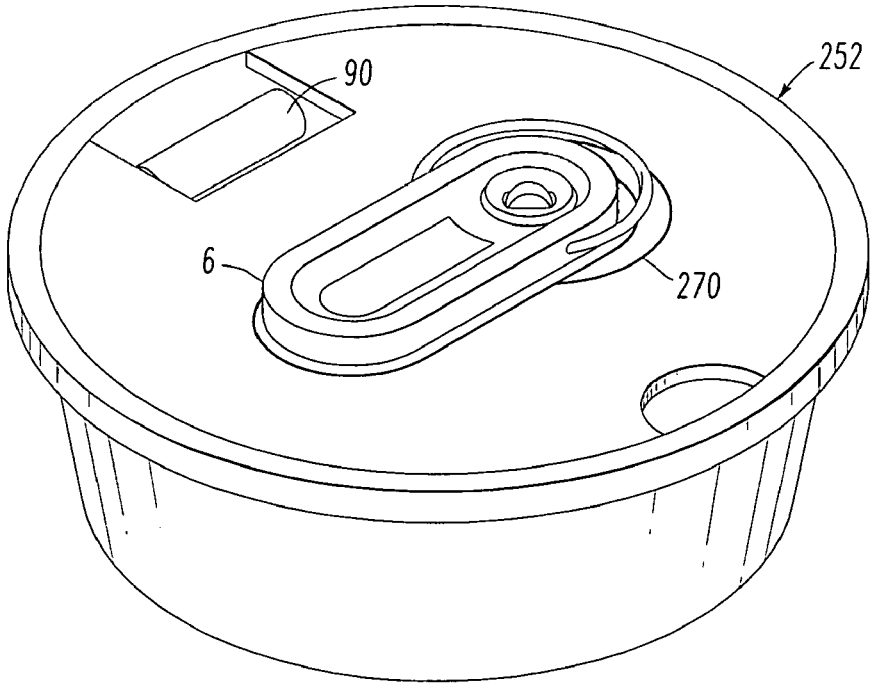
FIG. 11 is an isometric view showing the fob of FIG. 6 on the base of the pet dish of FIG. 9.

It is possible, however, that certain devices or sensors of the system 2 do not have a keyway, such as 232, for mating (e.g., docking) with the fob 6. For example, for functional and/or aesthetic reasons, the sensor might be embedded within or be substantially embedded in a household object (e.g., a water sensor 250 in a pet dish 252 (FIGS. 9-11); a door open/closed sensor 254 in a door 256 (FIG. 12)) such that a keyway is not practical or desirable. Hence, those devices or sensors need a corresponding structure to trigger the sending of the contemporaneous RF message, such as 242 of FIG. 8, with the fob RF message 236 (FIG. 7) to the base station 4. Here, the household objects, such as 252,256, like the sensor 8 of FIG. 8, employ, for example, the respective embedded sensors 250, 254, including an embedded magnet (M) 258 (FIG. 10) and an embedded proximity sensor, such as a reed switch 260 (FIG. 10), within the household object, but suitably close to an exterior surface, such as the base 262 (FIG. 10), in an orientation that expects a suitably precise collocation of one pair of the matching proximity sensors, such as reed switches 234, 264, and magnets 266,268 of the fob 6 (FIG. 6). In this example, as shown in FIGS. 6 and 10, the magnet (M) 258 of the pet dish object 252 is proximate the reed switch (R1) 234 of the fob 6, and the magnet (M1) 266 of the fob 6 is proximate the reed switch (R) 260 of the pet dish object 252 when the object and fob are suitably positioned as shown in FIG. 11.

By employing this structure, a non-physical keying of the household objects 252,256 can be performed. Preferably, a temporary label (e.g., "Place key here to train"), such as 270 of FIG. 10, is employed on a surface, such as 262, of the object 252 to guide the user to properly position the fob 6 on the object's surface. For example, the label 270 may be a removable label including an outline of the portable fob 6 to guide placement of the fob on the surface 262 proximate the reed switch 260 and magnet 258. In this manner, the two magnets 258,266 trigger the respective reed switches 234,260 in both the fob 6 and the pet dish object 252 within the appropriate timeframe, in order that the subsequent authentication and network joining process can occur.

Figure 12:
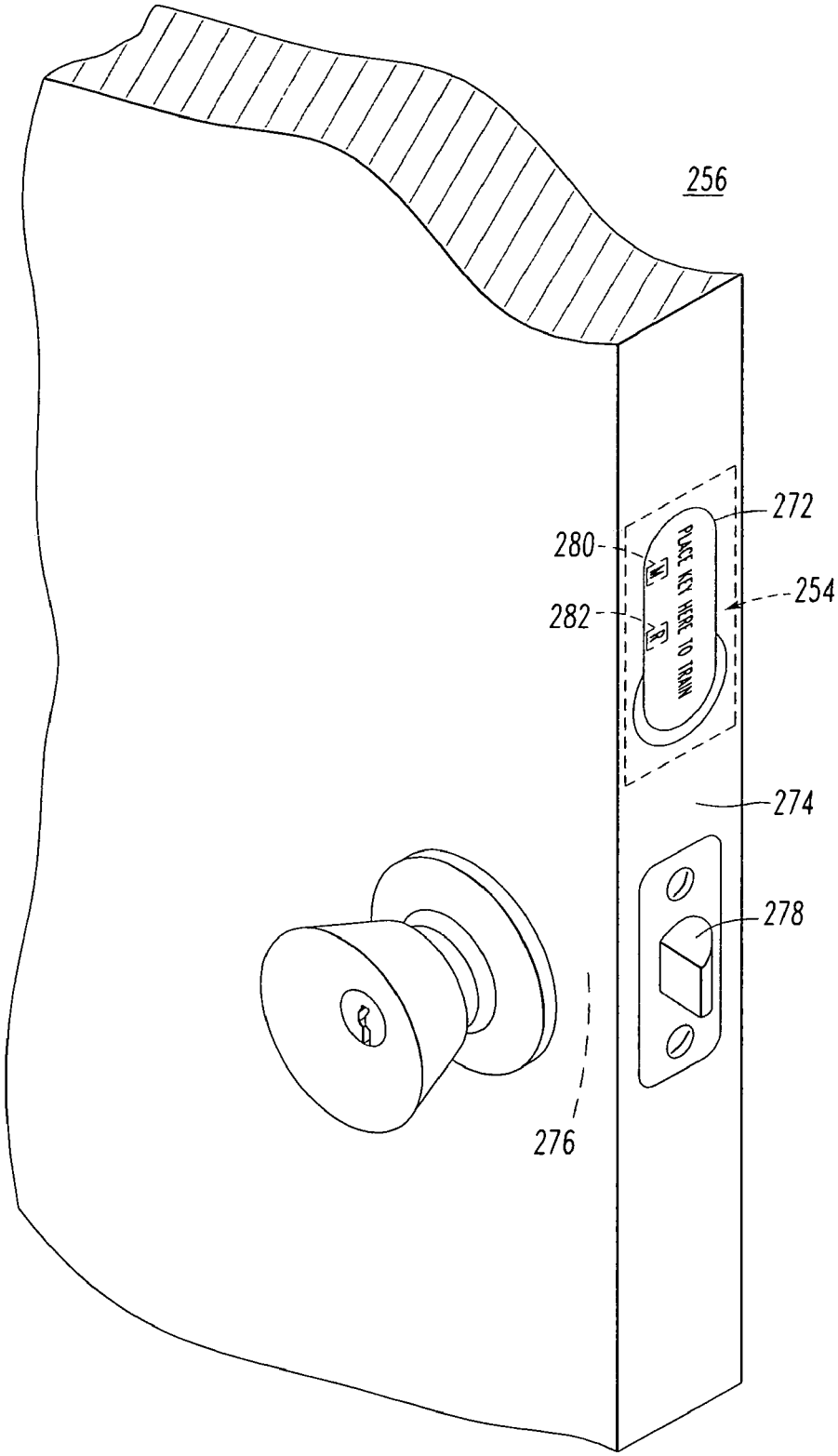
FIG. 12 is an isometric view of a door including an open/close sensing element embedded therein and being adapted to mate with the fob of FIG. 6.

Another example of a household object including an embedded sensor is the open/close sensor 254 embedded in the door 256 of FIG. 12. A label 272 on a surface, such as 274, of the door 256 indicates where the user should locate the fob 6 (FIG. 6) in order to enable the corresponding embedded sensor 254 to join the network 20 of FIG. 1.

It will be appreciated that the labels 270,272 may be located on any suitable surface of any suitable household object including a suitable embedded input sensor and/or suitable embedded output device. For example, the example door 256 may also include a door lock output device 276 that is at least substantially embedded within the door 256. For example, based upon an RF control command from the base station 4, the output device 276 may cause the lock 278 to assume a locked or unlocked position.

In both of the examples of FIGS. 11 and 12, the fob 6 (as shown in FIG. 11) is suitably placed on or proximate the pet dish 252 or the door 256 to train the corresponding sensor 250,254. It will be appreciated that a similar procedure is employed for the device 276. For example, there is a separate label (not shown) if the door 256 has both the sensor 254 and a separate door lock output device, such as 276, at a different location. For example, there is one magnet (M) 280 and one reed switch (R) 282 in the door 256 that mate with the corresponding reed switch (R1) 234 and the magnet (M1) 266 in the fob 6. Otherwise, there is a single label, such as 272, if the sensor 254 and device 276 are combined.

If the fob 6 was improperly positioned on the door 256 or the pet dish 252, then none or only one reed switch in one of the fob 6 or the object 252,256 might be activated and, thus, the two substantially contemporaneous RF messages 236,242 would not be sent from the fob 6 and the corresponding object 252,256 to the base station 4. Hence, the user would have to retry to properly position the fob 6 on the object. For example, a message (not shown) could be sent from the base station 4 to the fob 6 to display, for example: "remove and try (realign) again". This message could be "triggered" by the base station 4 only if it receives one of the two "join request" messages 236,242.

Figure 9:
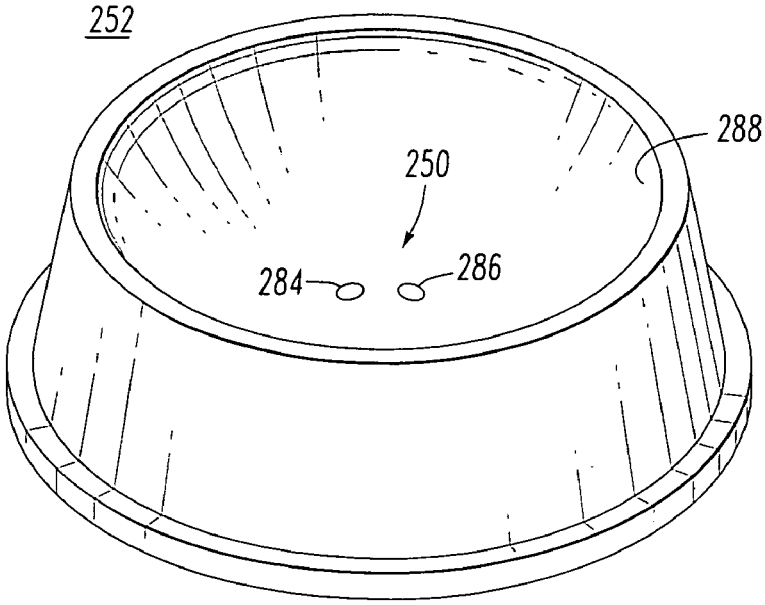
FIG. 9 is an isometric view of a pet dish including a water sensing element embedded therein in accordance with an embodiment of the invention.

The structure of the embedded water sensor 250 of FIG. 9 may be similar to the sensor 8 of FIG. 5. The sensor 250 includes electrical leads 284,286, a relatively small portion of which protrude into the bowl portion 288 of the pet dish 252 to detect the presence or absence of water (not shown) therein. The structure of the embedded open/close sensor 254 of FIG. 12 may also be similar to the sensor 8 of FIG. 5, except that a discrete proximity sensor (not shown), for example, may be employed in place of the analog input 110. Alternatively, an analog proximity sensor may be employed. The structure of the embedded door lock output device 276 may be similar to the output device 12 of FIG. 4.

Alternatively, any suitable household object may employ any suitable sensor, control or display device embedded therein or substantially within the object. For example, a temperature sensor embedded in a refrigerator (not shown), a power sensor embedded in an appliance (not shown), a water valve embedded in a garden sprinkler system (not shown), or any suitable sensor or device without a mating slot available to receive the fob 6. Other examples include windows or doors with embedded sensors in the door or window or frame, doors with deadbolt control devices embedded therein, cellular telephones and other handheld electronic display devices that are added to the wireless network 20 (FIG. 1). An electronic device, such as a stereo (not shown) or television (not shown), could have both control (e.g., on; off; other control functions) and sensor (e.g., "state"; what channel it is tuned to) functions that are controlled, configured or monitored by the fob 6, if the corresponding control device (e.g., RF output device 12 of FIG. 4) and/or sensor device (e.g., RF sensor 8 of FIG. 5) were embedded therein. Similarly, a telephone (not shown) could be trained to be used to display, for example, caller ID in the system 2 (FIG. 1) by having a sensor device (e.g., RF sensor 8 of FIG. 5) embedded therein. Appliances (e.g., without limitation, water heaters; washing machines; drying machines) could have control and/or sensor functions if the corresponding control device (e.g., RF output device 12 of FIG. 4) and/or sensor device (e.g., RF sensor 8 of FIG. 5) were embedded therein. Any household object that has a current visual "look" that would, otherwise, be altered by adding a keyway (e.g., 232 of FIG. 8) or that would be overly costly to retool versus embed could be have suitable control and/or sensor functions if the corresponding control device and/or sensor device were embedded therein.

Figure 13A:
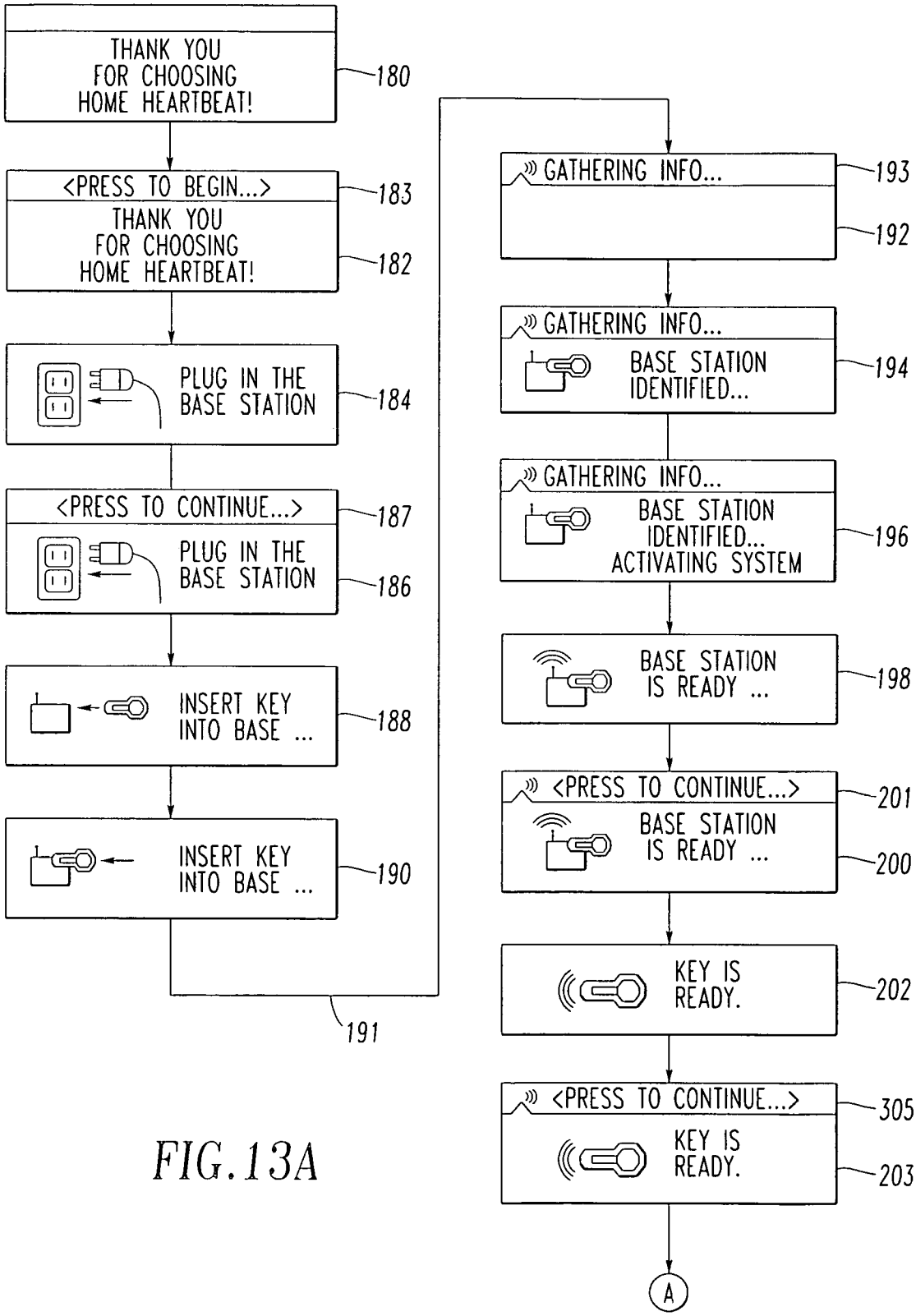
FIGS. 13A and 13B are examples of display sequences used by the fob for configuring the base station and sensors, respectively, of FIG. 1.
Figure 13B:
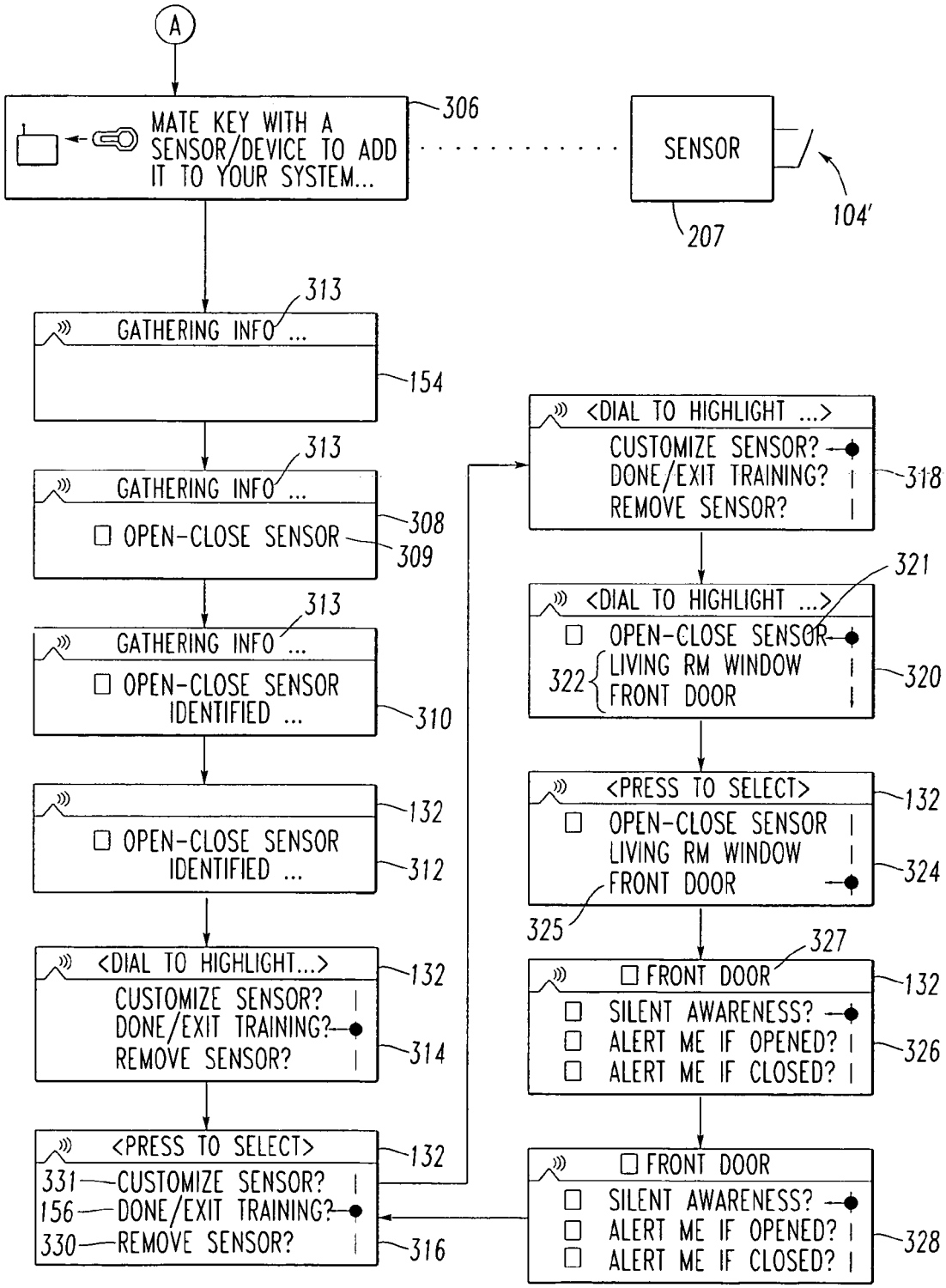

FIGS. 13A and 13B show sequences of displays employed by the fob 6 for configuring the base station 4 and the nodes 8,10,12, respectively, of FIG. 1. FIG. 13A shows a set of fob display screens that the user employs to configure the fob 6 and base station 4. First, screen 180 thanks the user for choosing the system 2. This is followed by screen 182, which prompts the user, at 183, to press the button 77 of FIG. 3 to begin (e.g., normal to the rotational axis 206 of the thumbwheel 208 of FIG. 6). The next two screens 184,186 respectively instruct the user to power (e.g., plug in an AC power cord 185 (FIG. 7)) the base station 4 and prompt the user, at 187, to press the button 77 to continue. The next two screens 188,190 graphically inform the user to insert the fob 6 into the base station 4. Those screens 188,190 are preferably repeated until the fob PIC processor 54 detects that one of the sensor/base/device proximity sensors 73,74 is active or closed. When that proximity sensor is active or closed in response to the fob 6 being suitably mated with the base station 4, the screen 190 transitions, at 191, to the screen 192, which informs the user, at 193, that the fob 6 is gathering (or exchanging) information with the base station 4 (e.g., the ID of the fob 6 is sent to the base station 4 via the RF transceivers over the wireless network 20, the ID of the base station 4 is sent to the fob 6, and other pertinent data is provided from the base station 4 to the fob 6) by exchanging a series of messages (not shown). Next, the user is informed by screen 194 that the base station 4 has been identified, by screen 196 that the system 2 is being activated, and by screen 198 that the base station 4 is ready. Then, screen 200 prompts the user, at 201, to press the button 77 to continue. In response to that action, screen 202 informs the user that the fob 6 is ready and, thus, that the fob RAM memory 60 (FIG. 3) includes, for example, the particular node ID of the base station 4 and that both the fob 6 and base station 4 are part of the system 2. Finally, screen 203 prompts the user, at 305, to press the button 77 to continue. When that action occurs, execution resumes with screen 306 of FIG. 13B.

At screen 306 of FIG. 13B, the user is instructed to mate the fob 6 with a sensor (e.g., a non-configured sensor 207) or output device (e.g., device 12 of FIG. 1 prior to it being added) in order to add it to the system 2 of FIG. 1. In summary, when one of the nodes 8,10,12 is keyed in this manner, the fob 6 begins gathering corresponding information and, then, reports the success to the user. As is discussed below, the fob 6 provides the ability to customize the sensor 207, with the status bar 132 cycling through two messages "<dial to highlight . . . >" and "press to select>". Following the screen 306, the screen 154 reports that the fob 6 is gathering information. This is possible, because there are two, and only two, nodes in the system 2 (e.g., the fob 6 and the particular sensor 207 (or the base station 4 or device 12), which are mated and which have their corresponding proximity sensors 73 or 74 and 104 or 104' closed or active at any one time). As is discussed below in connection with FIG. 14B, when the sensor proximity sensor 104' is closed or activated by mating with the fob 6, the sensor 207 sends a request to the base station 4 to join the network 20 (attempt_network_discovery). One of the fob proximity sensors 73,74 is also closed or activated (e.g., simultaneously) by mating with the sensor 207, and the fob 6 also sends a "program sensor" message to the base station 4. By receiving this "confirmation" message from the fob 6, the base station 4 knows to accept this sensor 207 to the network 20, and sends a nwk_connect_confirm message. Next, screen 308 reports the type of sensor (e.g., an Open-Close Sensor 309 in this example). Then, screen 310 reports that the sensor 207 is identified and screen 312 removes the "<gathering info . . . >" message 313 from the status bar 132.

Next, the screens 314 and 316 prompt the user to "<dial to highlight . . . >" and "<press to select>" one of the three displayed actions: "Customize sensor?", "Done/Exit Training?" And "Remove Sensor?". If the user highlights and presses (e.g, employing the button 77 of FIG. 3) "Customize sensor?" at screen 318, then screen 320 is displayed, which confirms that the sensor 207 is an "Open-Close Sensor" 321 and lists in the lower rotary (configuration) menu 322 the possible names of that sensor. In this example, there are two possible names shown, which are based upon the possible locations for such a sensor: Living R(oo)m Window and Front Door, wherein the parenthetical portion of those names is truncated for display in this example. Also, in this example, there may be one, three or more names and the display operation of the rotary (configuration) menu 322. Next, after the user highlights one of the names, such as Front Door 325, the screen 324 prompts the user to press the button 77 of FIG. 3 to select that name. Next, after the user selects the name, the screen 326 displays the name, Front Door 327, in the system message region 132, and prompts the user to select one of the sensor awareness levels, for example, "Silent awareness?", "Alert me if opened?" and "Alert me if closed?". Although, zero, one, two, three or more awareness levels may be employed for a particular sensor, in this example, "Silent Awareness?" means that the audible buzzer 84 (FIG. 3) of the fob 6 is inactive regardless of the state of that sensor. Otherwise, the user can select that an audible alert as determined by the base station 4 be sounded if that configured sensor is opened or if such sensor is closed. Next, at screen 328, the user, in this example, selects "Silent awareness?", which causes the screen 316 to be redisplayed. At that point, if the user highlights and selects the "Done/Exit Training?" option 156, then the newly entered information for the sensor 207 is transferred to the base station 4. Alternatively, if the user highlights and selects the "Remove sensor?" option 330, and regardless whether the sensor 207 was previously added, that information for such sensor is transferred to the base station 4, in order to remove the sensor 207 from the system 2. Finally, if the user highlights and selects the "Customize sensor?" option 331, screen 318 is redisplayed, no information is sent to the base station 4, and the user is prompted to re-enter the information to customize the sensor 207.

Figure 14A:
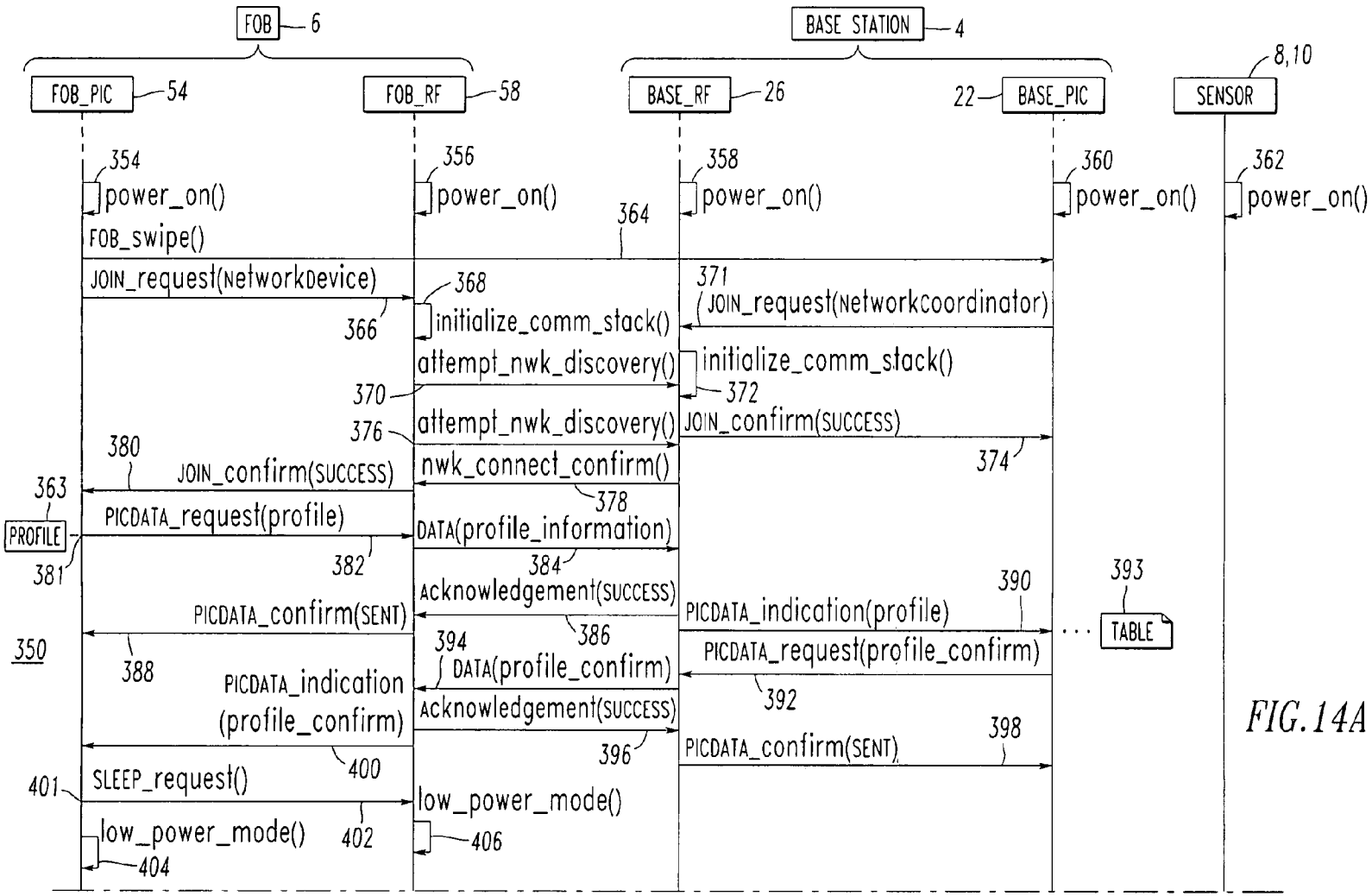
FIGS. 14A and 14B are message flow diagrams showing the interaction between the fob, one of the sensors and the base station of FIG. 1 for configuring the fob and the sensor, respectively.
Figure 14B:
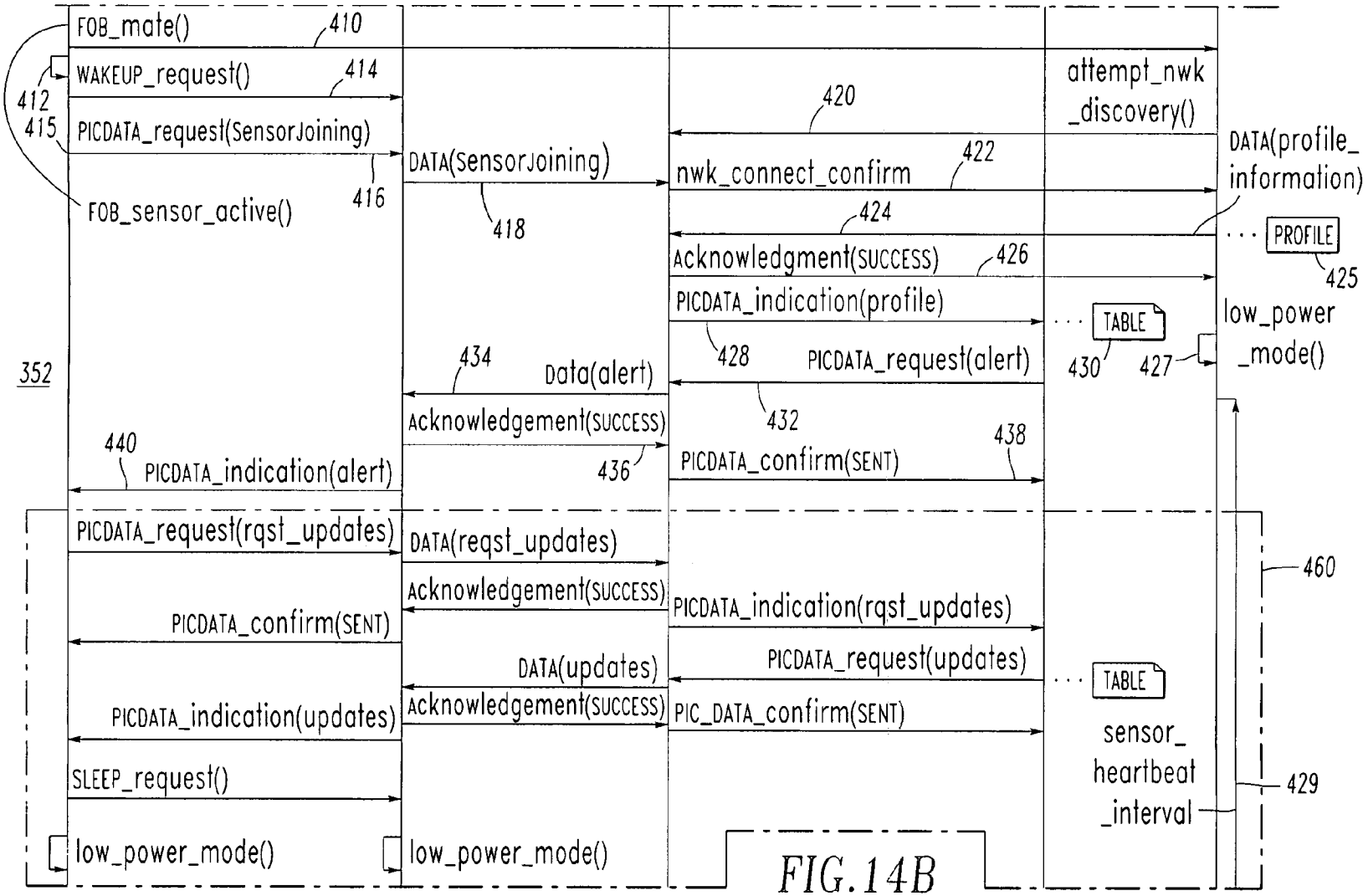

FIGS. 14A and 14B are message flow diagrams 350,352 showing the interaction between the fob 6, one sensor, such as 10, and the base station 4 of FIG. 1 for configuring that fob and sensor. In FIG. 14A, after the four processors 54,58,26,22 complete respective power_on( ) initialization 354,356,358, 360, the fob 6 may join the network 20 of the base station 4. The sensor 10 also initiates power_on( ) initialization 362.

Initially, in response to the screens 188,190 of FIG. 13A, the user undertakes a FOB_swipe( ) 364 of the fob 6 with the base station 4. In view of the screens 188,190, the fob PIC processor 54 knows, at this point, that the mated node is the base station 4. The fob PIC processor 54 detects the activation or closure of one of the sensor/base station/device proximity sensors 73,74 of FIG. 3 and responsively sends a JOIN_request(NetworkDevice) message 366 to the fob RF processor 58, which responsively executes an initialize_comm stack( ) routine 368. This routine 368 initializes the communication stack of that processor, which provides suitable software services for communication from one RF node (e.g., the fob 6) to another RF node (e.g., the base station 4). Next, the fob RF processor 58 sends an attempt_nwk_discovery( ) RF message 370 to the base RF processor 26, which may or may not be ready for that message. Only after the base station 4 has successfully initialized, will these discovery attempts of the fob 6 be successful. At that point, the fob 6 can transmit its profile 363 to the base station 4.

When the base PIC processor 22 is notified, as a result of the FOB_swipe( ) 364 of the fob 6 with the base station 4, of the closure or activation of one of the proximity sensors 41,42 of FIG. 2, it responsively sends a JOIN_request(NetworkCoordinator) 371 message to the base RF processor 26, which responsively executes an initialize_comm_stack( ) routine 372. As a result, the base communication stack is initialized and the base RF processor 26 is ready to accept requests from other nodes to join the network 20 of FIG. 1. When the routine 372 concludes, the base RF processor 26 sends a JOIN_confirm(SUCCESS) message 374 back to the base PIC processor 22. Therefore, the base RF processor 26 is now ready to accept requests from other nodes (e.g., the sensor 10; the fob 6) to join the network 20.

Although the first attempt_nwk_discovery( ) RF message 370 to the base RF processor 26 was ignored, since the routine 372 had not yet concluded, a second or subsequent attempt_nwk_discovery( ) RF message, such as 376, is sent to and is received by the base RF processor 26. That processor 26 receives the message 376 and responds with a nwk_connect_confirm( ) RF message 378 back to the fob RF processor 58. When the message 378 is received, the fob RF processor 58 sends a JOIN_confirm(SUCCESS) message 380 back to the base PIC processor 54.

The profile 363, for a node such as the fob 6, includes suitable node identification information, which, for example, identifies the node as a fob and provides the node ID and any attributes thereof. The profile 363 is transmitted to the base RF processor 26 after the fob RF processor 58 has joined the network 20 of FIG. 1. In this regard, the fob RF processor 58 may periodically attempt that action as shown by the example sequence of two attempt_nwk_discovery( ) RF messages. 370,376 to the base RF processor 26. It will be appreciated that one or more of such attempts are employed. Also, such attempts at discovery may be employed after power is on and independent of the engagement of the fob 6 with the base station 4.

At 381, the fob 6 can transmit its profile 363 to the base station 4. The fob PIC processor 54 sends a PICDATA_request(profile) message 382 to the fob RF processor 58, which responsively sends a DATA(profile_information) RF message 384. That message 384 is received by the base RF processor 26. In response, that processor 26 sends an Acknowledgement(SUCCESS) RF message 386 back to the fob RF processor 58. Upon receipt of that message 386 by the fob RF processor 58, it sends a PICDATA_confirm(SENT) message 388 back to the fob PIC processor 54.

After sending the Acknowledgement(SUCCESS) RF message 386, the base RF processor 26 sends a PICDATA_indication(profile) message 390 to the base PIC processor 22. Upon receipt of the message 390, the base PIC processor 22 sends a PICDATA_request(profile_confirm) message 392 to the base RF processor 26 and, also, stores the profile 363 for the fob 6 in an internal table 393 of nodes, which have been added to the network 20. Upon receipt of the message 392, the base RF processor 26 sends a DATA(profile_confirm) RF message 394 to the fob RF processor 58. Upon receipt of that message 394 by the fob RF processor 58, it sends an Acknowledgement(SUCCESS) RF message 396 back to the base RF processor 26 and sends a PICDATA_indication(profile_confirm) message 400 back to the fob PIC processor 54. In response to receipt of that message 400, the fob PIC processor 54 displays the fob acceptance screen 202 ("Key is ready.") of FIG. 13A to the user. Upon receipt of the RF message 396, the base RF processor 26 sends a PICDATA_confirm(SENT) message 398 to the base PIC processor 22. Finally, at 401, the fob PIC processor 54 sends a SLEEP_request( ) message 402 to the fob RF processor 58 and both fob processors 54,58 enter a low_power_mode( ) 404,406, respectively.

Referring to FIG. 14B, in order to join one of the sensors, such as 10, to the network 20 of FIG. 1, the user suitably mates the fob 6 with that sensor. In response, the fob PIC processor 54 detects one of the sensor/base station/device proximity sensors 73,74 of FIG. 3 being closed or active. The screen 154 of FIG. 13B may say "please wait . . . " (not shown) because, at this point, one of the fob proximity sensors 73,74 (FIG. 3) has been activated. At this point, the fob 6 does not know the nature of the mated node (e.g., whether it is a device, sensor or base station), since, for example, a stray magnet (not shown) might have triggered one of its proximity sensors 73,74. As will be discussed, the fob 6 then sends out the RF message 418 and the sensor 8 sends out the RF message 420. The base station 4 receives both RF messages 418,420 and, then, the fob 6 finds out that the mated node is a sensor and displays "sensor/device found" (not shown) and "gathering info" 313 (FIG. 13B). Otherwise, the fob 6 just displays "please wait . . . " for a suitable time (e.g., a few seconds) and then goes back to its home screen (not shown) because it did not receive information from the base station 4 about the new sensor 8. Otherwise, in view of the screen 308 of FIG. 13B, the fob 6 knows, at this point, that the mated node is a sensor.

Following the FOB_sensor_active( ) routine 412, the fob PIC processor 54 send a WAKEUP_request( ) message 414 to the fob RF processor 58. Similar to the fob RF processor's RF messages 370,376, the sensor 10 periodically sends RF messages, such as the attempt_nwk_discovery( ) RF message 420, to the base RF processor 26. The RF message 420 wirelessly communicates a signature (e.g., address; serial number) of the sensor 10 to the base station 4. Otherwise, the sensor 10 goes to a low power mode, such as 427, if the network discovery attempts are unsuccessful. The sensor 10 then retries (not shown) such network discovery attempts after a suitable time in low power mode.

At 415, after sending the wakeup message 414, the fob PIC processor 54 sends a PICDATA_request(SensorJoining) message 416 to the fob RF processor 58, which, in turn, sends a DATA(SensorJoining) RF message 418 to the base RF processor 26. The action of the FOB_mate( ) 410 also causes the sensor 10 to detect the closure or activation of the sensor proximity sensor 104' of FIG. 5. Preferably, that action triggers the first RF message 420.

In view of the two RF messages 418,420 to the base RF processor 26, it responsively sends a nwk_connect_confirm( ) RF message 422 back to the sensor 10. Upon receipt of that RF message 422, the sensor 10 sends a DATA(profile_information) RF message 424 back to the base RF processor 26. That RF message 424 includes the sensor profile 425, which includes suitable node identification information, such as type of node (e.g., sensor), the type of sensor (e.g., on/off; one input; battery powered), the node ID and any suitable attributes of the sensor 10. Upon receipt of that RF message 424, the base RF processor 26 sends the sensor 10 an Acknowledgment(SUCCESS) RF message 426. Next, the base RF processor 26 sends the base PIC processor 22 a PICDATA_indication(profile) message 428, including the sensor profile 425. The base PIC processor 22 receives that message 428 and stores the profile 425 in the table 430. The base PIC processor 22 also sends the base RF processor 26 a PICDATA_request(alert) message 432, which indicates that a new sensor 10 has been added to network 20. As will be seen, this message 432 is ultimately communicated to the fob 6, which will, then, need to responsively request data associated with the newly added sensor 10.

After receiving the Acknowledgment(SUCCESS) RF message 426, the sensor 10 enters the low_power_mode( ) 427. In turn, after a suitable sensor_heartbeat_interval 429, the sensor 10 wakes up and responsively sends sensor data in an RF message (not shown) to the base station 4.

Upon receipt of the PICDATA_request(alert) message 432, the base RF processor 26 sends a Data(alert) RF message 434 to the fob RF processor 58, which receives that RF message 434 and responsively sends an Acknowledgement(SUCCESS) RF message 436 back to the base RF processor 26. Upon receipt of the RF message 436, the base RF processor 26 sends a PICDATA_confirm(SENT) message 438 to the base PIC processor 22. Then, after the fob RF processor 58 sends the RF message 436, it sends a PICDATA_indication (alert) message 440 to the fob PIC processor 54. Next, the message sequence 460 is executed to provide sensor information for the newly added sensor 10 to the fob 6.

As part of the sensor profile 425, the sensor 10 provides, for example, a node ID, a network address and/or a unique sensor serial number. As part of the messages 416,418, the fob 6 provides a graphical identifier (e.g., a label; sensor name; sensor attribute) associated with the configuration of the sensor (e.g., screen 324 of FIG. 13B provides the name "Front Door" 325 for the sensor being configured).

The example labels 270,272 may be temporary, semi-permanent or permanent and may be formed by any suitable manner (e.g., without limitation, written; typed; printed; stamped; embossed; impressed; molded). For example, a water valve device (not shown) may have a molded impression (not shown) of the back of the fob 6. As another alternative, the label may be a template (not shown) that is placed on the sensor or device and that includes suitable alignment indicia (not shown) (e.g., openings; legends) to illustrate the proper positioning of the fob 6 relative to the sensor or device.

While for clarity of disclosure reference has been made herein to the exemplary display 78 for displaying monitoring, configuration and/or control information, it will be appreciated that such information may be stored, printed on hard copy, be computer modified, or be combined with other data. All such processing shall be deemed to fall within the terms "display" or "displaying" as employed herein.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A system for a structure, said system for a structure comprising:

a server comprising a wireless port;

a portable fob comprising:

a portable housing, a first wireless port adapted to wirelessly communicate with the wireless port of said server, a second port, a user input device, a display, and a processor operatively associated with the first wireless port, the second port, the user input device and the display; and a node comprising:

a household object, and a sensor, control or display device embedded in or substantially within said household object, said sensor, control or display device comprising:

a first wireless port adapted to wirelessly communicate with the wireless port of said server, a second port adapted to communicate with the second port of said portable fob when said portable fob is proximate to said sensor, control or display device, and a processor operatively associated with the first wireless port of said sensor, control or display device and the second port of said sensor, control or display device, said processor of said sensor, control or display device being adapted to receive proximity information from the second port of said sensor, control or display device and responsively communicate with said server through the first wireless port of said sensor, control or display device, in order to configure said sensor, control or display device.

2. The system for a structure of claim 1 wherein said server further comprises a second port; and wherein the second port of said portable fob is adapted to temporarily or momentarily mate with the second port of said server.

3. The system for a structure of claim 1 wherein the second port of said sensor, control or display device includes a proximity sensor embedded within said household object; and wherein said household object has a surface with a label disposed thereon proximate said proximity sensor.

4. The system for a structure of claim 3 wherein said label is a removable label including an outline of said portable fob to guide placement of said portable fob on the surface of said household object proximate said proximity sensor.

5. The system for a structure of claim 3 wherein the second port of said sensor, control or display device further includes a magnet embedded within said household object.

6. The system for a structure of claim 5 wherein said proximity sensor is a reed switch.

7. The system for a structure of claim 1 wherein the processor of said portable fob is adapted to receive proximity information from the second port of said portable fob, to select node information responsive to said user input device, said node information describing said node, and to send said node information to the wireless port of said server from the first wireless port of said portable fob.

8. A node for a system for a structure, said system for a structure including a server and a fob, said node comprising:

a household object; and a sensor, control or display device embedded in or substantially within said household object, said sensor, control or display device comprising:

a wireless port adapted to wirelessly communicate with said server, a proximity sensor embedded within said household object and being structured to sense when said fob is proximate to said proximity sensor, and a processor operatively associated with said wireless port and said proximity sensor, said processor being adapted to receive proximity information from said proximity sensor and responsively communicate with said server through said wireless port, in order to configure said sensor, control or display device.

9. A node for a system for a structure, said system for a structure including a server and a fob, said node comprising:

a household object; and a sensor, control or display device embedded in or substantially within said household object, said sensor, control or display device comprising:

a first wireless port adapted to wirelessly communicate with said server, a second port adapted to communicate with said fob when said fob is proximate to said second port, and a processor operatively associated with said first wireless port and said second port, said processor being adapted to receive proximity information from the second port and responsively communicate with said server through said first wireless port, in order to configure said sensor, control or display device, wherein the second port of said sensor, control or display device includes a proximity sensor embedded within said household object; and wherein said household object has a surface with a label disposed thereon proximate said proximity sensor.

10. The node of claim 9 wherein said label is a removable label including an outline of said portable fob to guide placement of said portable fob on the surface of said household object proximate said proximity sensor.

11. The node of claim 9 wherein the second port of said sensor, control or display device further includes a magnet embedded within said household object.

12. The node of claim 11 wherein said proximity sensor is a reed switch.

13. A method of configuring a household object as part of a system for a structure, said system for a structure including a server and a portable fob, said method comprising:

embedding a sensor, control or display device in or substantially within said household object;

placing said portable fob proximate said household object; and employing a proximity sensor of said household object to sense said portable fob being proximate said household object and responsively wirelessly communicating from said sensor, control or display device to the server of said system for a structure, in order to configure said household object as part of said system for a structure.

14. The method of claim 13 further comprising employing a sensor as said sensor, control or display device;

embedding the last said employed sensor within said household object; and placing said portable fob on said household object proximate said proximity sensor.

15. The method of claim 14 further comprising displaying a list of graphical identifiers at said portable fob;

associating said graphical identifiers with corresponding sensor names and corresponding sensor attributes;

selecting one of said graphical identifiers;

wirelessly communicating a signature from the last said employed sensor to said server; and wirelessly communicating the corresponding sensor name and the corresponding sensor attribute for the selected one of said graphical identifiers from said portable fob to said server.

16. The method of claim 13 further comprising employing a pet dish as said household object;

employing a water sensor as said sensor, control or display device; and embedding said water sensor substantially within said pet dish.

17. The method of claim 13 further comprising employing a door as said household object;

employing an open/close sensor as said sensor, control or display device; and embedding said open/close sensor in said door.

18. The method of claim 13 further comprising employing a door as said household object;

employing a lock as said sensor, control or display device; and embedding said lock substantially within said door.

19. The method of claim 13 further comprising employing a sensor or control device as said sensor, control or display device;

wirelessly communicating a signature from said sensor or control device to said server responsive to placing said portable fob proximate said proximity sensor;

wirelessly communicating a message from said portable fob to said server responsive to placing said portable fob proximate said proximity sensor; and receiving both of said signature and said message at said server before configuring said sensor or control device as part of said system for a structure.

20. The method of claim 13 further comprising mating said portable fob with said server before placing said portable fob proximate said household object.

21. A method of configuring a household object as part of a system for a structure, said system for a structure including a server and a portable fob, said method comprising:

embedding a sensor, control or display device in or substantially within said household object;

placing said portable fob proximate said household object;

sensing said portable fob being proximate said household object and responsively wirelessly communicating from said sensor, control or display device to the server of said system for a structure, in order to configure said household object as part of said system for a structure;

embedding a proximity sensor within said household object;

employing said household object having a surface;

disposing a label on the surface of said household object proximate said proximity sensor; and employing said label to place said portable fob on the surface of said household object proximate said proximity sensor.

22. The method of claim 21 further comprising employing as said label a removable label including an outline of said portable fob to guide placement of said portable fob on the surface of said household object proximate said proximity sensor.

23. A method of configuring a household object as part of a system for a structure, said system for a structure including a server and a portable fob, said method comprising:

embedding a sensor, control or display device in or substantially within said household object;

placing said portable fob proximate said household object;

sensing said portable fob being proximate said household object and responsively wirelessly communicating from said sensor, control or display device to the server of said system for a structure, in order to configure said household object as part of said system for a structure;

embedding a first magnet and a first proximity sensor within said household object;

embedding a second magnet and a second proximity sensor within said portable fob; and placing said portable fob proximate said household object with said first magnet being proximate said second proximity sensor and with said second magnet being proximate said first proximity sensor.

* * * * *